United States Patent [19]

Sewell

[11] Patent Number: 4,884,343

[45] Date of Patent: Dec. 5, 1989

[54] SKI BASE FLATTENER

[76] Inventor: Mark S. Sewell, 4611 Quail Hollow Ct., Fair Oaks, Calif. 95628

[21] Appl. No.: 243,725

[22] Filed: Sep. 13, 1988

[51] Int. Cl.[4] ..... A63C 11/06; B23D 67/12

[52] U.S. Cl. ..... 30/169; 30/287; 51/205 WG; 76/83; 76/88

[58] Field of Search ..... 30/169, 172, 286, 287; 51/205 WG; 76/83, 88; 7/158

[56] References Cited

U.S. PATENT DOCUMENTS

| | | | |
|---|---|---|---|
| 3,875,825 | 4/1975 | Buttafuoco | 51/205 WG X |
| 4,060,013 | 11/1977 | Thompson | 76/88 X |
| 4,089,076 | 5/1978 | Sparling | 7/158 |
| 4,442,636 | 4/1984 | Obland | 51/205 WG |
| 4,509,297 | 4/1985 | Lindgren | 76/83 X |
| 4,557,030 | 12/1985 | Gaston et al. | 30/172 X |

*Primary Examiner*—Douglas D. Watts
*Assistant Examiner*—Rinaldi Rada
*Attorney, Agent, or Firm*—Jones, Tullar & Cooper

[57] ABSTRACT

A ski base flattener uses a base scraping blade of metal or stone to plane or scrape the base of a ski. The blade is removably held in the base flattener by a blade holding wedge. A scraping edge of the blade and a front glide bar contact the base of the ski while guide legs position the base flattener correctly on the ski base.

16 Claims, 2 Drawing Sheets

FIG. 1
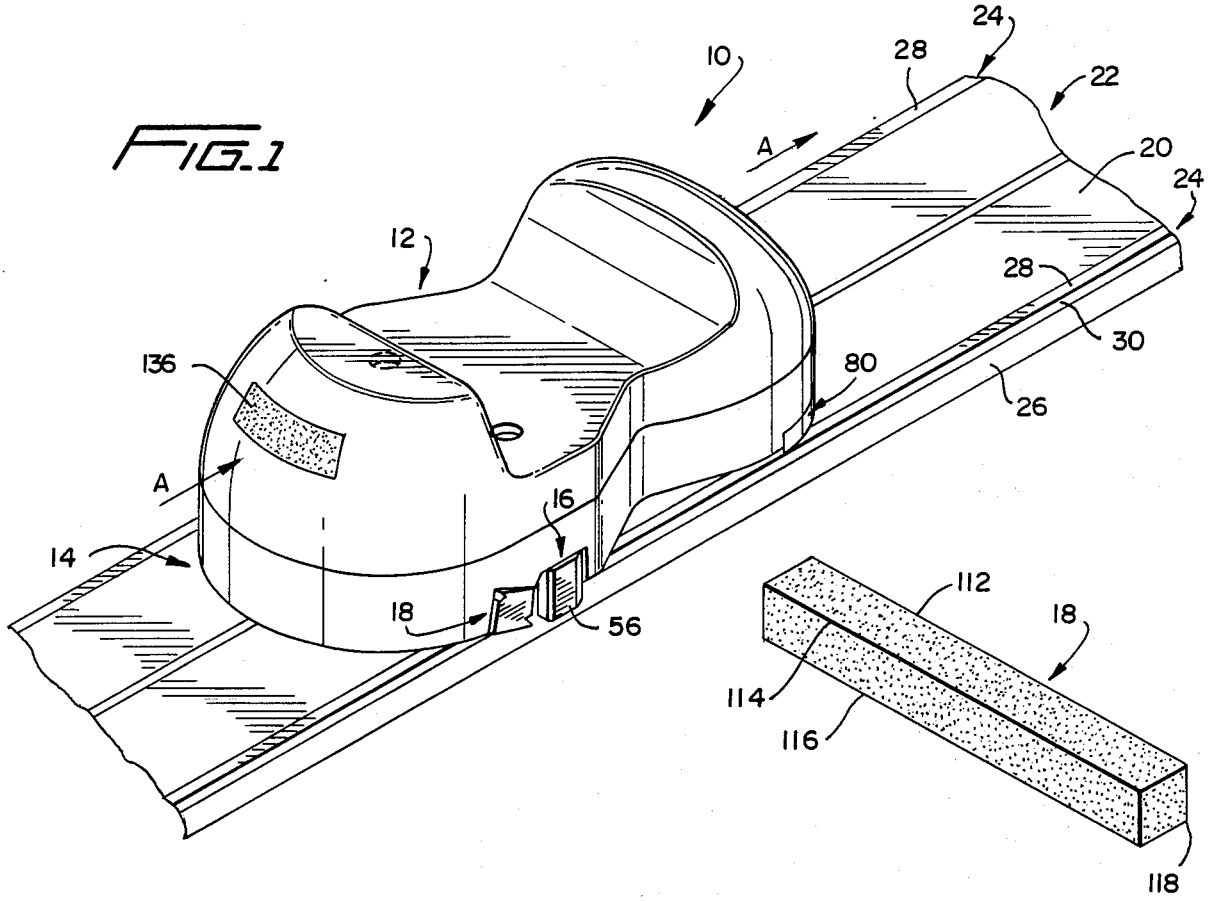
FIG. 8
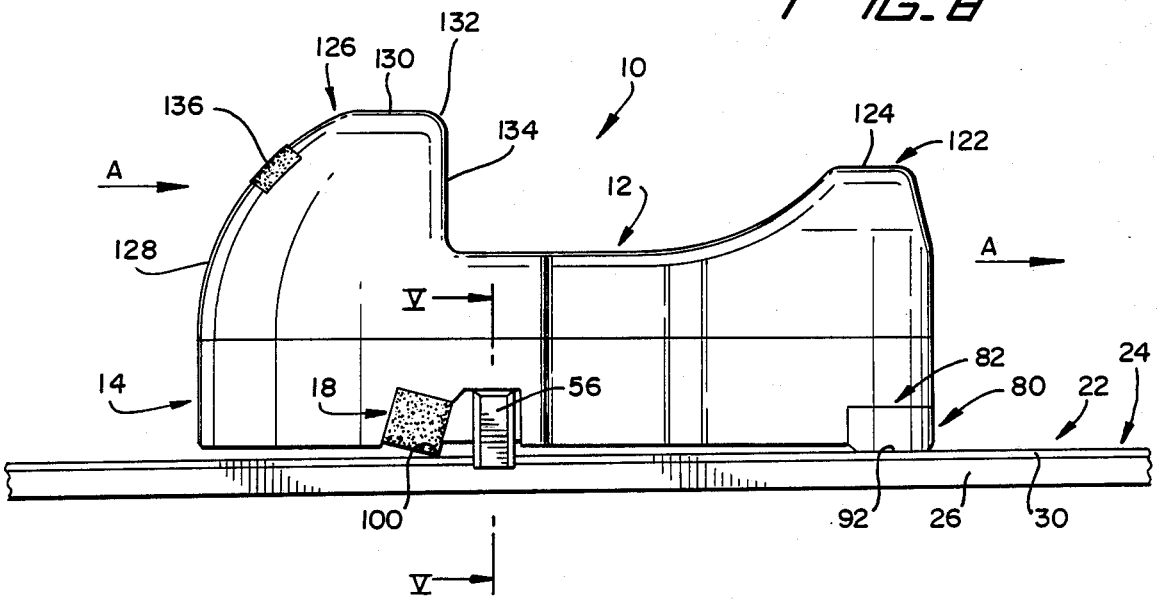
FIG. 2

FIG. 3
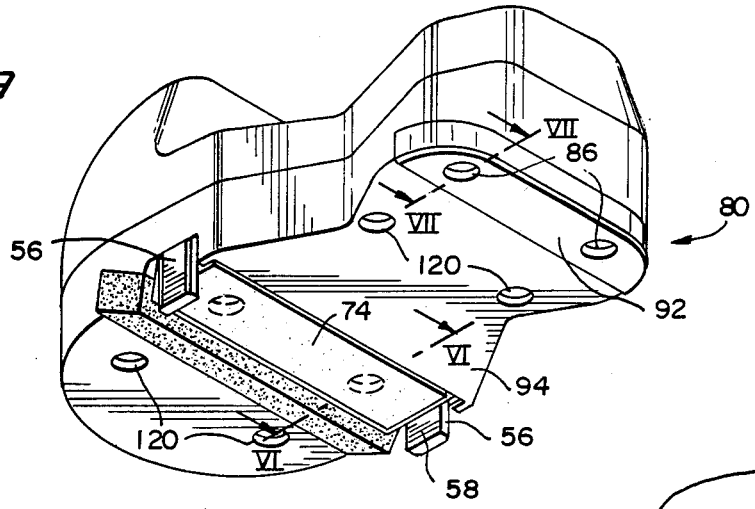
FIG. 4
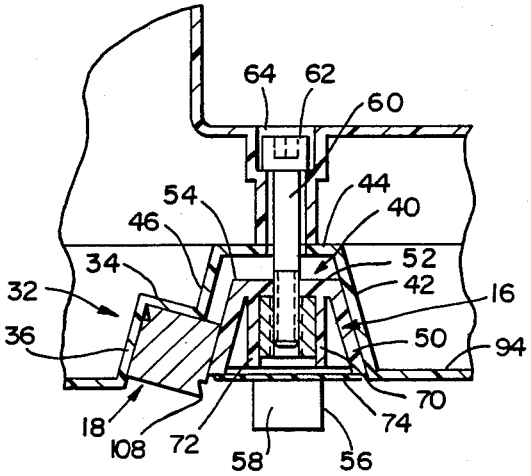
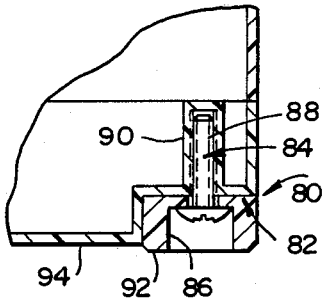
FIG. 7
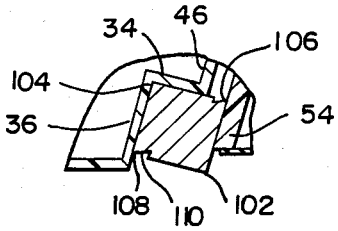
FIG. 6
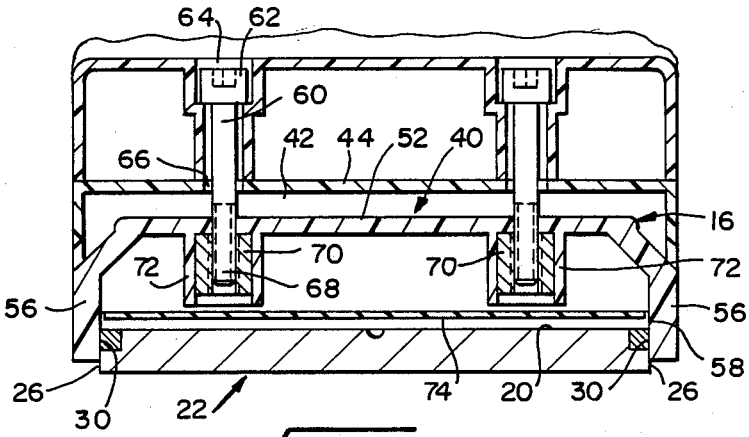
FIG. 5

SKI BASE FLATTENER

FIELD OF THE INVENTION

The present invention is directed generally to a ski base flattener. More particularly, the present invention is directed to a manually operable ski base flattener. Most specifically, the present invention is directed to a manually operable ski base flattener which has interchangable metal and stone blades. The ski base flattener has a molded plastic housing whose upper surface is configured to be complimentary with, and to be securely graspable by the user's hands. A removable blade holding wedge properly positions the blade at an optimum working angle. This blade holding wedge further carries spaced downwardly extending ski edge engaging guide legs. The ski base flattener is used by manually pushing it along the base of the ski to properly flatten the base and edges of the ski. Interchanging of the metal and stone blades increases the usefulness of the flattener.

DESCRIPTION OF THE PRIOR ART

Modern downhill snow skis typically have a base surface made of high molecular weight polyethylene or the like to which are joined metal edge strips. For a ski to perform safely and effectively, it is important that the base surface be flat and that the metal edges be properly tuned. In the past various tools and procedures have been advocated for use in properly flattening the base surfaces of skis but these tools and procedures have either been unsuitable for use by the skier himself or have not be particularly effective.

Commercial ski repair shops, ski tuning facilities, and the like often use a large belt sander or a large power driven stone wheel to flatten ski bases. These commercial devices may or may not do a proper job of flattening the base surface of the ski, depending on their trueness and the skill of the operator, but are clearly not suitable for an individual skier to use to tune his own skis. Large belt sanders and stone wheels, which are frequently used by ski manufacturers and ski tuning shops, may not impart a truly flat surface to the base of the ski and may also case harden the metal edges. This case hardening may occur through improper use of stone grinding equipment, either at the factory or at the ski tuning facility. Once ski edges have become case hardened they are very difficult to sharpen or tune.

In the past, the individual skier who desired to care for and tune his own skis has typically used a flat file or sharp metal scraper blade to plane off material from the base of the ski and edges to attempt to arrive at a flat base. All to often, the result has been a ski base which has not been flat and which has been damaged by attempted base flattening. As anyone who has attempted it will attest, the use of a flat file, or a metal edge scraper to produce a flat ski base is not an easy task. When these prior art devices are used to attempt to flatten the base of a ski, the result is frequently a base which is either concave or convex. A concave base makes the ski's edges grabby, unpredictable and unsafe. This condition should be corrected before the ski is used. A convex base will make the ski tend to wander because it is not running on a true surface. Again, this condition needs to be corrected before the ski is to be used.

Prior manual base flattening devices, such as flat files and metal edge scrapers have been difficult to hold and not easily sharpened. It is difficult to hold a flat file so that it is actually flat across the base of the ski and to simultaneously apply pressure to the file. Similarly, it is difficult to apply uniform pressure across the width of a metal blade scraper and to maintain that pressure while moving the blade along the length of the ski. Further, it is not easy to maintain either a flat file or a metal edge scraper in a true, sharp, effective condition.

It will thus be apparent that the prior base flattening devices have not been completely satisfactory, have been apt to produce other than flat ski bases, and have been difficult to use and to maintain in a proper condition. The need exists for a base flattener which will overcome the limitations of the prior devices and which will allow a ski base to be placed in a flat condition and to be properly maintained. The ski base flattener in accordance with the present invention provides such a device and is a significant advance in the art.

SUMMARY OF THE INVENTION

It is an object of the present invention to provide a ski base flattener.

Another object of the present invention is to provide a manually operable ski base flattener.

A further object of the present invention is to provide a manually operable ski base flattener having a removable scraping blade.

Yet another object of the present invention is to provide a ski base flattener having interchangable metal and stone blades.

Still a further object of the present invention is to provide a manually operable ski base flattener having spaced ski engaging guide legs.

Even yet another object of the present invention is to provide a ski base flattener having a comfort enhancing front hand grasping surface and a power enhancing rear hand grasping surface.

Still even a further object of the present invention is to provide a ski base flattener having a magnetic strip for holding metal ski edge shavings.

As will be discussed in greater detail in the description of the preferred embodiment which is set forth subsequently, the ski base flattener in accordance with the present invention utilizes a molded plastic body to removably support interchangable metal and stone blades. The metal blade is most efficient in scraping the metal ski edges while the stone blade is primarily effective in scraping and structuring the plastic base of the ski. Either of these blades is held in the ski base flattener at generally about a negative 15 degree angle and is quickly removable for cleaning or replacement. A pair of guide legs are provided, and cooperate with the sides of the ski on which the base flattener is being used, to insure that the base flattener will not slip off the ski. These guide legs, and a front glide bar, are both replaceable so that new ones can be put in place when the old ones have become worn. The upper surface of the base flattener is provided with a front, comfort enhancing hand grip and a rear, power enhancing hand grip. These make the base flattener of the present invention easily grasped and controlled.

The ski base flattener in accordance with the present invention is intended primarily for use by the individual who wants to properly tune his own skis. As such, it is manually operable, as opposed to the machine driven belt sanders and grinding wheels used by ski tuning shops and ski manufacturers. While it could certainly be used by a professional ski tuner, it is not primarily intended to be a high volume tuning device. Since it does not use fast moving belts or wheels, it will not case harden ski edges and will not cause other similar problems which may occur when a belt sander or grinding wheel is used.

The ski base flattener is accordance with the present invention can receive either a metal blade or a stone blade. Both of these blades are removably carried in the base of the tool at preferably a negative 15 degree angle which is optimal for giving the maximum scraping ability with minimum risk of skipping the tool along the base.

The blade is held in a transverse slot in the base of the tool by a blade holding wedge that has a pair of downwardly extending ski side surface engaging guide legs. The working blade may be quickly removed and replaced by loosening this blade holding wedge in the base of the base flattener. The wedge with its associated guide legs, and a front glide bar,, which is removably secured to the forward portion of the flattener, can be quickly replaced when they become worn.

The ski base flattener in accordance with the present invention allows the user to impart to his skis a flat uniform base, and to maintain that base. The base flattener is structured to be simple yet effective, to be rugged and durable yet not costly, and to be useable by the individual skier. It is far superior to prior files and scrapers and is a substantive step forward in the art.

BRIEF DESCRIPTION OF THE DRAWINGS

While the novel feature of the ski base flattener in accordance with the present invention are set forth with particularlity in the appended claims, a full and complete understanding of the invention may be had by referring to the detailed description of the preferred embodiment which is presented subsequently, and as illustrated in the accompanying drawings in which:

FIG. 1 is a perspective view of the ski base flattener in accordance with the present invention in use on a ski;

FIG. 2 is a side elevation view of the ski base flattener;

FIG. 3 is a perspective view from beneath, of the ski base flattener;

FIG. 4 is a cross-sectional side elevation view of the tool holding wedge and tool portion of the ski base flattener and taken along line IV—IV of FIG. 3;

FIG. 5 is a tranverse cross-sectional view of the tool holding wedge portion of the base flattener and taken along line V—V of FIG. 1;

FIG. 6 is an enlarged cross-sectional view of the metal tool of the base flattener;

FIG. 7 is a cross-sectional view of the front glide bar and taken along line VII—VII of FIG. 3; and FIG. 8 is a perspective view of a stone blade for use in the ski base flattener in accordance with the present invention.

DETAILED DESCRIPTION OF THE PREFERRED EMBODIMENT

Referring initially to FIG. 1 there may be seen, generally at 10, a preferred embodiment of a ski base flattener in accordance with the present invention. Ski base flattener 10 is comprised generally of a molded plastic upper body 12, a molded plastic lower body 14, a base scraping blade holding wedge 16, and a base scraping blade 18 which is held in lower body 14 by holding wedge 16. As seen in FIGS. 1 and 3, the ski base flattener 10 is positionable on, and slidable along a base surface 20 of a typical downhill ski 22 which is provided with metal edge strips 24 that are positioned in the ski 22 at the juncture of the ski base 20 and ski side walls 26. It will be further understood that each of these metal edge strips 24 has a metal edge strip base surface 28 and a metal edge strip side surface 30. The construction of such skis is well known in the art and forms no part of the present invention. Typically, the ski base surface 20 is a very high molecular weight polyethylene. The hardness of this ski base 20 is to some extent a function of the intended use of the ski, such as recreation or racing, and the base may be a relatively softer extruded one or a relative harder sintered one. The ski base flattener 10 in accordance with the present invention is equally useable with the various ski bases on the market and will allow the user to properly flatten and maintain flat the base 20 of his skis 22.

Ski base scraping blade 18 is removably carried at a negative cutting angle of generally about 15°, in a transverse blade holding slot 32 which is seen most clearly in FIG. 4. Blade slot 32 has a top wall 34 and a rear wall 36. This blade slot 32 is molded integrally in the lower body 14 of the base flattener 10 and is situated just to the rear, in the direction of movement of blade flattener 10 in use as indicated by arrows A in FIGS. 1 and 2, of a transverse blade holding wedge receiving recess 40. Recess 40 is generally parallel to blade slot 32 and itself is formed by a recess front wall 42, a recess top wall 44, and a recess rear wall 46, all as may be seen most clearly in FIG. 4. The rear wall 46 of blade holding wedge receiving recess 40 intersects the top wall 34 of blade receiving slot 32. This recess 40 is generally trapezoidal in cross-section, as depicted in FIG. 4 and is generally complementary in shape with blade holding wedge 16.

As may be seen in greater detail in FIGS. 4 and 5, blade holding wedge 16 is also generally trapezoidal in cross-section and has a sloped front wall 50, a generally planar top wall 52, and a sloped rear wall 54. Downwardly extending guide legs 56 are formed on the outboard ends of blade holding wedge 16 and these depend downwardly below the level of sloped front and rear wedge walls 50 and 54, respectively, as may be seen most clearly in FIGS. 4 and 5. Inner surfaces 58 of these guide legs 56 are in sliding contact with the side surfaces 30 of metal edge strips 24 and with the sides 26 of ski 22, as may be seen most clearly in FIG. 5, when ski base flattener 10 is being moved along the base surface 20 of ski 22. These guide legs 56 thus serve to keep the ski base flattener 10 on the base surface 20 of the ski 22.

Returning to FIGS. 4 and 5, the blade holding wedge 16 is removably secured in wedge receiving recess 40 by a pair of spaced screws 60 which preferably have allen heads 62. These screws pass through cooperatively shaped apertures 64 in upper body 12, correspondingly positioned apertures 66 in the lower body 14 and have threaded lower ends 68 which are engageable with threaded metal inserts 70 that are carried in cylindrical sleeves 72 which are molded or otherwise formed integrally with the under surface of the top wall 52 of blade holding wedge 16 and depend downwardly therefrom. As may also be seen in FIG. 5, the body of blade holding wedge 16, which is preferably a one piece molded device and which uses a high strength, wear resistant plastic to provide long life to guide legs 56, is hollow. A flexible magnetic material impregnated strip 74 is adhesively affixed to the lower surface of wedge 16 and is used to retain metal scrapings that may be generated when scraping blade 18 contacts and scrapes away portions of the metal edge strip base surface 28.

In use, a base scraping blade 18, which is generally in the shape of an elongated, square bar as will be discussed in greater detail subsequently, is placed in blade slot 32 with adjacent top and rear surfaces of the blade 18 being in contact with the top wall 34 and rear wall 36 of slot 32. The blade holding wedge 16 is then placed in its adjacent recess 40 and the wedge holding screws 60 are positioned so that their threaded ends 68 engage the metal inserts 70. Rotation of the wedge holding screws 60 will thus pull wedge 16 into recess 40 as the front wall 50 of the wedge slides along the front surface 42 of recess 40. At the same time, the sloped rear wall 54 of the wedge 16 will come into contact with a front surface of blade 18 to thereby hold blade 18 in its slot 32. Blade 18 will typically be positioned in slot 32 as depicted in the drawings; i.e., with its ends generally adjacent the sides of the lower body 14. However in certain uses, such as to scrape a convex portion of the base away, it may be desirable to offset blade 18 partly to one side or the other of lower body 14. This can be accomplished in the present device as long as a substantive portion of blade 18 is still in recess 32 and in contact with wedge 16. To remove blade 18, it is only necessary to loosen the wedge holding screws 60 an amount sufficient to slide the wedge 16 downwardly in recess 40 so that the forward face of the blade 18 is no longer in contact with the sloped rear wall 54 of the blade holding wedge 54 of the blade holding wedge 16.

A front glide bar, generally at 80, is removably secured in a cut-out 82 that is formed at a forward end of the lower body 14 of base flattener 10. This front glide bar 80 is made of a long wearing, high strength plastic or the like and is used as a front support for base flattener 10. This glide bar 80 is attached to the lower body 14 by use of suitable glide bar securing screws 84 that are placed in spaced glide bar apertures 86, and which have threaded shanks 88 that are received in molded, threaded sleeves 90 which are formed integrally with lower body 14, as may be seen most clearly in FIG. 7. A lower glide surface 92 of front glide bar 80 extends beneath a lower planar surface portion 94 of the lower body part 14. As may be seen most clearly in FIG. 2, in use, the base flattener 10 is supported on base 20 of ski 22 by glide surface 92 and a scraping edge 100 of base scraping blade 18. Thus, downwardly and forwardly directed pressure exerted on the upper body 12 of the base flattener 10 is transferred to scraping edge 100 and is not wasted on frictional forces that would tend to be generated by a large surface area contact between the lower surface 94 of the lower body 14 with the ski base surface 20.

As was alluded to previously, and as may be seen in the various drawings, base scraping blade 18 may either be a metal blade, as depicted in FIGS. 1, 4, and 6, or a stone blade, as depicted in FIGS. 2, 3 and 8. Each blade, either of metal or stone, is preferably generally square in cross-section and has a length generally the same as that of blade slot 32. As may be seen most clearly in FIGS. 4 and 6, the metal blade preferably has two opposed right angle scraping edges 102 and 104, and two opposed acute angle scraping edges 106 and 108. These acute edges are formed by cutting generally 10° slices 110 in the faces of the metal blade adjacent the acute angle scraping edges 106 and 108. These acute edges are more sharp that the right angle edges and are used when a significant scraping is to be made on the ski base surface 20 or when the user of the base flattener 10 has less strength or weight that might otherwise be required. Since the scraping blade 18 is preferably square in cross-section, it can be rotated in slot 32 to position the desired edge 102, 104, 106 or 108 in the operative position. In use, it has been found that the metal blade is most efficient at scraping or planing the metal edge strips 24 while being less efficient at flattening the plastic base material than is the stone blade.

Stone blade 18, as seen most clearly in FIG. 8 is preferably square in cross-section and has four similar scraping or planing edges 112. 114, 116 and 118. The stone blade is made of a somewhat porous material such as aluminum oxide or silicone carbide. The term stone blade is used since these materials are often used in grinding stones or wheels. The pores on the stone blade 18 are an effective scraping or planing mechanism on the plastic ski base. This stone blade will not skip or gouge the hard plastic base 20 and is very easy to use. A further advantage of stone blade 18 is that the porous nature of the blade's edges provide a serrated scraping edge. This serrated edge imparts a structure or texture to the plastic base surface 20 of ski 22 which breaks the surface tension between the snow and the ski base so that the ski will glide better. By using stone blades 18 having different grits, the depth of the structuring of the base 20 can be varied. The stone blade 18 is more suited for use with skis in which the metal edges have been beveled, such as by using the ski tuning device in my pending patent application 226,899 filed Aug. 1, 1988, and in which the base surface 20 is not grossly convex or concave. If the skis are in poor condition, they should first be flattened using the metal blade 18.

Returning now to FIGS. 1, 3 and 4, the molded plastic upper body 12 and the molded plastic lower body 14 are preferably joined together by suitable screws or other fasteners which are not shown in the drawings but which are inserted in fastener apertures 120 in the planar lower surface 94 of the lower body 14. It will be understood that base flattener 10 could have a one piece body. However, the molded plastic two piece body is easier and less expensive to mold and has significant savings of material and weight. Base flattener 10 is intended to be grasped by both hands of the user and is structured to maximize the power and control which the user may exert. The front portion of upper body 12 has a comfort front hand handle 122 which is in the form of a transverse raised rib 124. The rear portion of upper body 12 has a power rear hand handle 126. This includes a rounded rear heel 128 which extends up to a somewhat planar upper surface 130. This upper surface 130 terminates at its forward edge 132 in a generally vertical and planar front face 134. In use, the person's less dominant hand is placed on the comfort front hand handle 122 while the palm of the more dominant hand is brought into contact with the rounded rear heel 128 of the rear power hand handle 126. A grip enhancing pad 136 of sandpaper on the like may be adhesively adhered to heel 128. The finger of the dominant hand will curl over the planer upper surface 130 and the finger tips contact planar front face 134. This structure of base flattener 10 thus affords the user maximum comfort and control. It will be understood that this overall shape is not limited to use with a ski base flattener but could be used with other planing, scraping, or cutting tools.

In use, a base scraping blade 18 of either metal or stone, depending on the condition of the ski to be worked on, is placed in blade slot 32 and is held in place by tightening wedge holding screws 60 to draw blade holding wedge 16 into its cooperatively shaped recess 40. The ski base flattener 10 is then positioned on the base surface 20 of a ski 22, as seen in FIGS. 1 and 2, and is pushed along the ski, typically from the tip to the tail. As was discussed above, the blade edge 100 and the lower glide surface 92 of the front glide bar 80 contact the ski base 20 while the inner surfaces 58 of the guide legs 56 engage the sides 30 of the metal edge strips 24. Both the glide bar 80 and the blade holding wedge 16, of which the guide legs 56 are a part, are replaceable since they will be worn by their contact with the base 20 and metal edge strips 24. As was also discussed above, the base scraping blade 18 is held in its recess 32 at a negative scraping angle of generally about 15°. This angle of generally about 15° has been determined to be the most desirable for base scraping. It will be understood that this angle is variable within a range from generally about 0° to 25°. As was also discussed above, it may be advantageous to start with a metal blade 18 to perform gross base flattening and to then use a stone blade 18 for final base flattening and structuring. Any metal shavings generated during the flattening will be held by the recessed magnetic strip 74 and can be brushed away between strokes. The metal blade 18 can be re-sharpened by using a sharpening stone as can the stone blade. Additionally, the stone blade can be cleaned by using a metal brush to remove plastic base particles from the pores of the stone.

The ski base flattener 10 of the present invention allows a person to properly and accurately maintain the base surfaces of his skis in a flat, structured condition. It uses a properly angled scraping blade of selectably either metal or stone to restore non-flat ski bases to a flat condition and to maintain them this way. The base flattener is shaped to maximize the control and comfort of the user and also facilitates quick, easy and accurate blade installation and removal. The forward glide base and the spaced guide legs maintain the base flattener in position on the base of the ski and are easily replaced when they become worn. It will thus be seen that the ski base flattener of the present invention is a very useable tool which clearly enhances the user's ability to care for his skis.

While a preferred embodiment of a ski base flattener in accordance with the present invention has been fully and completely set further hereinabove, it will be apparent to one of skill in the art that a number of changes in, for example, the materials used to form the body of the device, the type of fasteners used, and the like could be made without departing from the true spirit and scope of the invention which is accordingly to be limited only by the following claims.

What is claimed is:

1. A ski base flattener which is useable to remove material from the base of a ski, said ski base flattener comprising;

a body having a generally planar base surface with a scraping blade receiving slot and a blade holding wedge receiving recess formed adjacent said base surface and extending generally transverse to a direction of motion of said body along the base of the ski;

a base scraping blade removably positionable in said blade receiving slot; and a base scraping blade holding wedge removably positionable in said recess to effect the securement of said blade in said slot.

2. The ski base flattener of claim 1 wherein said blade is positionable in said slot at a negative scraping angle.

3. The ski base flattener of claim 2 wherein said negative scraping angle is between about 0°–25°.

4. The ski base flattener of claim 1 wherein said body has a glide bar generally at a forward portion of said planar base surface.

5. The ski base flattener of claim 4 wherein a lower glide surface of said glide bar is generally parallel to, and extends below said planar base surface.

6. The ski base flattener of claim 1 wherein said base scraping blade has a plurality of scraping edges.

7. The ski base flattener of claim 6 wherein at least one of said scraping edges is an acute angle.

8. The ski base flattener of claim 6 wherein said base scraping blade is generally four-sided in cross-section.

9. The ski base flattener of claim 1 wherein said scraping blade is stone.

10. The ski base flattener of claim 1 wherein said base scraping blade holding wedge has opposed, downwardly extending guide legs at ends thereof, said guide legs being spaced sufficiently to transversely straddle the base of the ski when said ski base flattener is positioned atop the base of the ski.

11. The ski base flattener of claim 1 wherein said body has a comfort front hand handle and a power rear hand handle.

12. The ski base flattener of claim 11 wherein said comfort front hand handle includes a transverse raised rib.

13. The ski base flattener of claim 11 wherein said power rear hand handle includes a rounded rear heel and a generally planar vertical front face.

14. The ski base flattener of claim 1 wherein said base scraping blade holding wedge carries a magnetic strip.

15. The ski base flattener of claim 1 wherein said body includes a molded plastic upper body portion and a molded plastic lower body portion.

16. The ski base flattener of claim 1 wherein said blade is metal.

* * * * *